US006629070B1

(12) United States Patent
Nagasaki

(10) Patent No.: US 6,629,070 B1
(45) Date of Patent: Sep. 30, 2003

(54) VOICE ACTIVITY DETECTION USING THE DEGREE OF ENERGY VARIATION AMONG MULTIPLE ADJACENT PAIRS OF SUBFRAMES

(75) Inventor: Mayumi Nagasaki, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/451,864

(22) Filed: Dec. 1, 1999

(30) Foreign Application Priority Data

Dec. 1, 1998 (JP) ..... 10-341714

(51) Int. Cl.[7] ..... G10L 11/02
(52) U.S. Cl. ..... 704/233
(58) Field of Search ..... 704/201, 233

(56) References Cited

U.S. PATENT DOCUMENTS

| | | | | | |
|---|---|---|---|---|---|
| 5,835,889 | A | * | 11/1998 | Kapanen | 704/215 |
| 5,915,234 | A | * | 6/1999 | Itoh | 704/219 |
| 6,202,046 | B1 | * | 3/2001 | Oshikiri et al. | 704/233 |
| 6,240,381 | B1 | * | 5/2001 | Newson | 704/214 |
| 6,275,798 | B1 | * | 8/2001 | Johansson et al. | 704/233 |

FOREIGN PATENT DOCUMENTS

| | | |
|---|---|---|
| JP | 04-299400 | 10/1992 |
| JP | 06-175693 | 6/1994 |
| JP | 06-266380 | 9/1994 |
| JP | 07-336290 | 12/1995 |
| JP | 09-152894 | 6/1997 |

OTHER PUBLICATIONS

Japanese Unexamined Patent Application Publication S63–175895.

Japanese Unexamined Patent Application Publication S64–55956.

Japanese Unexamined Patent Application Publication H2–272836.

Japanese Unexamined Patent Application Publication H6–75599.

Japanese Unexamined Patent Application Publication H7–135490.

Japanese Unexamined Patent Application Publication H7–168599.

Japanese Unexamined Patent Application Publication H8–36400.

Japanese Unexamined Patent Application Publication H8–305388.

Japanese Unexamined Patent Application Publication H9–152894.

Japanese Unexamined Patent Application Publication H9–185397.

Japanese Unexamined Patent Application Publication H2–148099.

* cited by examiner

*Primary Examiner*—Tālivaldis Ivars Šmits
(74) *Attorney, Agent, or Firm*—Foley & Lardner

(57) ABSTRACT

Disclosed is a method for detecting a voice presence/absence state of a frame which is obtained by dividing a voice signal into frames, comprising steps of: dividing the frame into sub-frames; calculating a physical amount of the voice signal energy in each sub-frame; and determining whether the frame is in a voice presence state or a voice absence state on the basis of a degree of variation of energy among multiple adjoining pairs of the sub-frames.

6 Claims, 7 Drawing Sheets

A CASE THE BEGINNING OF A PHONATION IS AT THE BEGINNING OF A FRAME

A CASE THE BEGINNING OF A PHONATION IS IN THE MIDDLE OF A FRAME

VOICE ACTIVITY DETECTION USING THE DEGREE OF ENERGY VARIATION AMONG MULTIPLE ADJACENT PAIRS OF SUBFRAMES

BACKGROUND OF THE INVENTION

1. Field of the Invention

The present invention relates to a method and apparatus for detecting voice presence/absence state, and a method and apparatus for encoding a voice signal which include the method and apparatus for detecting voice presence/absence state, respectively. The method and apparatus for encoding a voice signal are used in a portable telephone and an automobile telephone for example.

2. Description of the Prior Art

A background noise generating system has been disclosed in for example JPA 7-336290 titled "VOX Controlled Communication Apparatus (translated title)". Next, with reference to FIGS. 1 and 2, the related art reference will be described in brief.

FIG. 1 is a block diagram showing the structure of the apparatus according to the related art reference. FIG. 2 is a flow chart showing the operation of the apparatus according to the related art reference.

As shown in FIG. 1, the apparatus according to the related art reference comprises a voice signal input terminal 610, a frame dividing portion 620, a voice presence state detecting portion 630, a controlling portion 640, a highly efficient voice encoding portion 650, a switch 660, and an encoded signal output terminal 670. The voice presence state detecting portion 630 comprises a frame energy calculating portion 631 and a voice presence/absence state determining portion 632.

Next, the overall operation of the apparatus according to the related art reference will be described in brief.

The frame dividing portion 620 receives a voice signal from the voice signal input terminal 610 (at step B1). The frame dividing portion 620 divides the voice signal into frames (with a period of 20 msec each). The frames are supplied to the voice presence state detecting portion 630 and the highly efficient voice encoding portion 650 (at step B2).

The frame energy calculating portion 631 calculates the intensity of energy of each frame of the voice signal and supplies the calculated data to the voice presence/absence state determining portion 632 (at step B3).

The voice presence/absence state determining portion 632 determines whether or not the intensity of energy of each frame received from the frame energy calculating portion 631 is larger than a predetermined threshold value. When the intensity of energy of the current frame is larger than the predetermined threshold value, the voice presence/absence state determining portion 632 determines that the current frame is a voice frame. When the intensity of energy of the current frame is not larger than the predetermined threshold value, the voice presence/absence state determining portion 632 determines that the current frame is a non-voice frame. The voice presence/absence state determining portion 632 supplies the determined result to the controlling portion 640 (at step B4).

The controlling portion 640 controls the highly efficient voice encoding portion 650 and the switch 660 corresponding to the determined result received from the voice presence/absence state determining portion 632 (at step B5).

In another related art reference as JPA 9-152894 titled "Voice presence/absence state determining apparatus (translated title)", an apparatus that accurately determines whether or not each frame is a voice frame including the beginning portion of a phonation is disclosed. In the apparatus according to this related art reference, a sub-frame power calculating portion calculates the power of each of four sub-frames into which each frame is divided. A frame maximum power generating portion calculates the average value of the power of each sub-frame and the moving average of the power between adjoining two sub-frames, compares the moving average values of any sub-frames in the same frame, and selects the maximum moving average as the maximum power of the frame. Thus, even if a phonation starts from a later portion of a frame, the frame maximum power is prevented from being underestimated. Consequently, a voice presence state determining portion can securely determine that the current frame is a voice frame.

However, the related art references have the following disadvantages.

As a first disadvantage, if the voice presence/absence state changes in the middle of each frame, the frame cannot be accurately determined as a voice frame.

This is because the intensity of energy of a voice signal which will be a determination factor for the voice presence/absence state is calculated for each frame as the voice process.

As a second disadvantage, a frame that partly contains pulse noise may be determined as a voice frame.

This is because when the intensity of energy of the pulse noise is too large, the intensity of energy of the entire frame becomes larger than the voice presence/absence determination threshold value. Thus, the frame is determined as a voice frame.

SUMMARY OF THE INVENTION

In order to overcome the aforementioned disadvantages, the present invention has been made and accordingly, has an to provide a method and apparatus for accurately determining whether or not each frame is a voice frame even if a voice presence/absence state changes in the middle of the frame and even if each frame partly contains pulse noise.

According to a first aspect of the present invention, there is provided a method for detecting a voice presence/absence state of a frame which is obtained by dividing a voice signal into frames, comprising steps of: dividing the frame into sub-frames; calculating a physical amount of the voice signal in each sub-frame; and determining whether the frame is in a voice presence state or a voice absence state on the basis of a degree of variation of the physical amount among the sub-frames.

According to a second aspect of the present invention, there is provided a method for detecting a voice presence/absence state of a frame which is obtained by dividing a voice signal into frames, comprising steps of: dividing the frame into sub-frames; calculating a periodicity of the voice signal in each sub-frame; and determining whether the frame is in a voice presence state or a voice absence state on the basis of the periodicity of the voice signal in each sub-frame.

According to a third aspect of the present invention, there is provided a method for encoding a voice signal, comprising steps of: dividing a voice signal into frames: detecting a voice presence/absence state of each frame; encoding the voice signal for each frame; and determining whether to output the encoded voice signal for each frame; wherein the steps of encoding and determination are controlled by a result of the step of detection; and wherein the step of detection comprises steps of: dividing the frame into sub-frames; calculating a physical amount of the voice signal in each sub-frame; and determining whether the frame is in a voice presence state or a voice absence state on the basis of a degree of variation of the physical amount among the sub-frames.

According to a fourth aspect of the present invention, there is provided a method for encoding a voice signal, comprising steps of: dividing a voice signal into frames: detecting a voice presence/absence state of each frame; encoding the voice signal for each frame; and determining whether to output the encoded voice signal for each frame; wherein the steps of encoding and determination are controlled by a result of the step of detection; and wherein the step of detection comprises steps of: dividing the frame into sub-frames; calculating a periodicity of the voice signal in each sub-frame; and determining whether the frame is in a voice presence state or a voice absence state on the basis of the periodicity of the voice signal in each sub-frame.

These and other objects, features and advantages of the present invention will become more apparent in light of the following detailed description of a best mode embodiment thereof, as illustrated in the accompanying drawings.

DESCRIPTION OF PREFERRED EMBODIMENTS

[Operation]

Before explaining embodiments of the present invention, the operation of the present invention will be described.

The present invention provides a structure for accurately detecting a voice presence state at the beginning of a phonation, the structure is used for a voice encoding apparatus having a function for detecting voice presence/absence states.

According to the present invention, since it is determined whether each frame is a voice frame corresponding to both the intensity of energy of each analysis region shorter than each frame and the degree of variation thereof or to at least the degree of variation, even if a voice presence/absence state changes at the middle portion of a frame so that the beginning of a phonation locates in the middle of the frame, the frame can be accurately determined as a voice frame.

According to the present invention, the energy change rate of each analysis region is also added as a determination condition. When the energy change rate is too high, it is presumed as a change of other than a voice signal. Thus, a frame that partly contains pulse noise can be accurately determined as a non-voice frame. In the second related art reference disclosed in JPA 9-152894, the average value of the intensity of power of past several frames and the maximum value of the intensity of power of the current frame are compared. However, according to the present invention, the degree of variation of the intensity of power of the as current frame is used as a determination condition.

According to the second related art reference, the maximum value of the intensity of power of a plurality of sub-frames is defined as the frame power. The maximum value is compared with the value of the intensity of the background noise power. In contrast, according to the present invention, the maximum value of the intensity of power is not defined as the frame power. In other words, each frame is determined as a voice frame corresponding to the degree of variation of the intensity of power of each sub-frame. Thus, according to the related art reference, when very large pulse noise enters a frame in the communication environment, since the maximum value of the intensity of power is used, the frame may be mistakenly determined as a voice frame. In contrast, according to the present invention, since this frame is presumed as a frame that partly contains a pulse noise, the frame can be accurately determined as a non-voice frame.

According to the related art reference, as a determination factor for detecting a voice frame, parameters that represent the value of the intensity of power and a frequency spectrum are used. In contrast, according to the present invention, the periodicity of signal pitches is also used as a determination factor. Thus, a voice factor can be more accurately detected.

Figure 1:
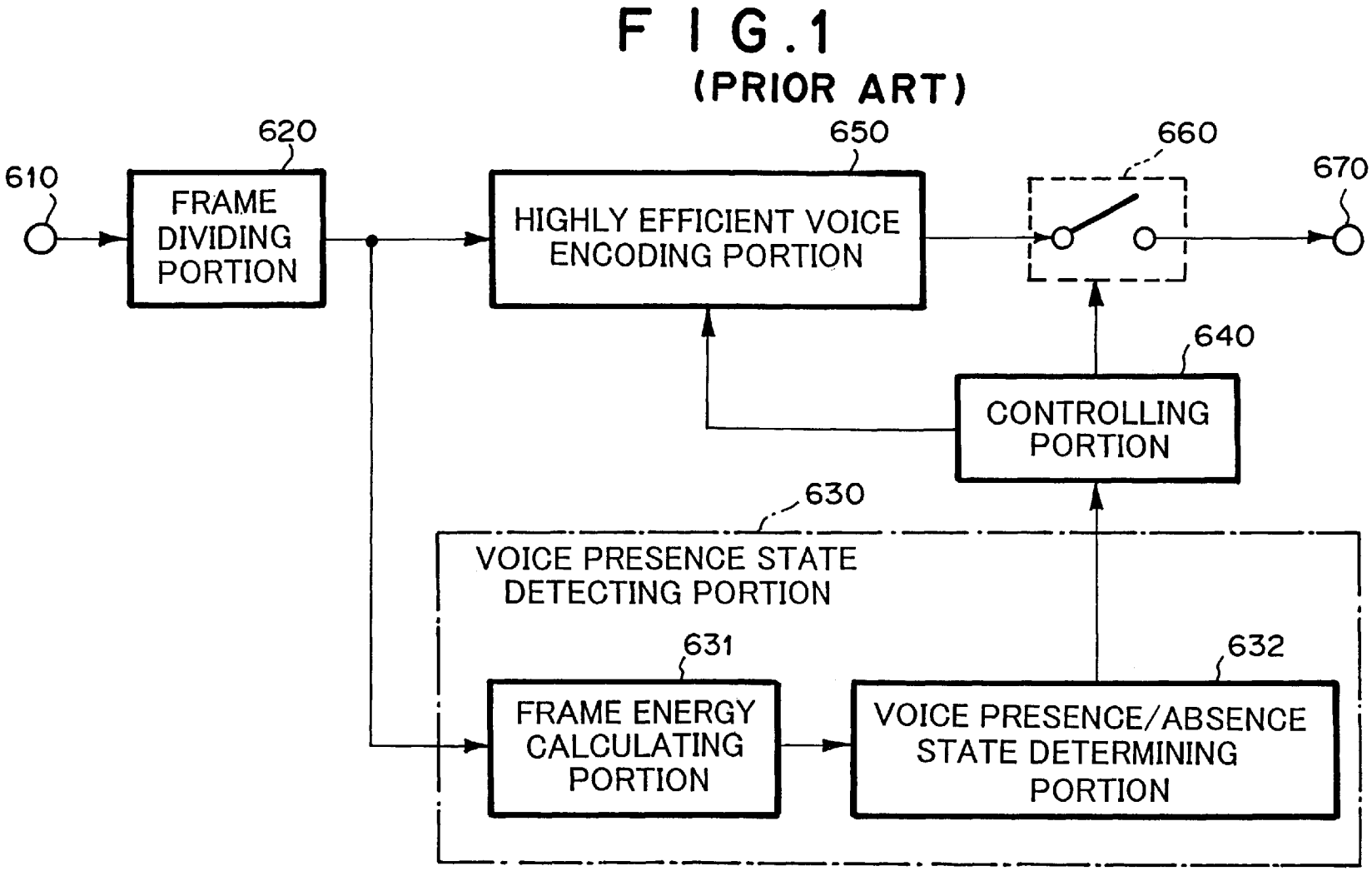
FIG.1 (PRIOR ART)
FIG. 1 is a block diagram showing the structure of an apparatus according to a related art reference.
Figure 2:
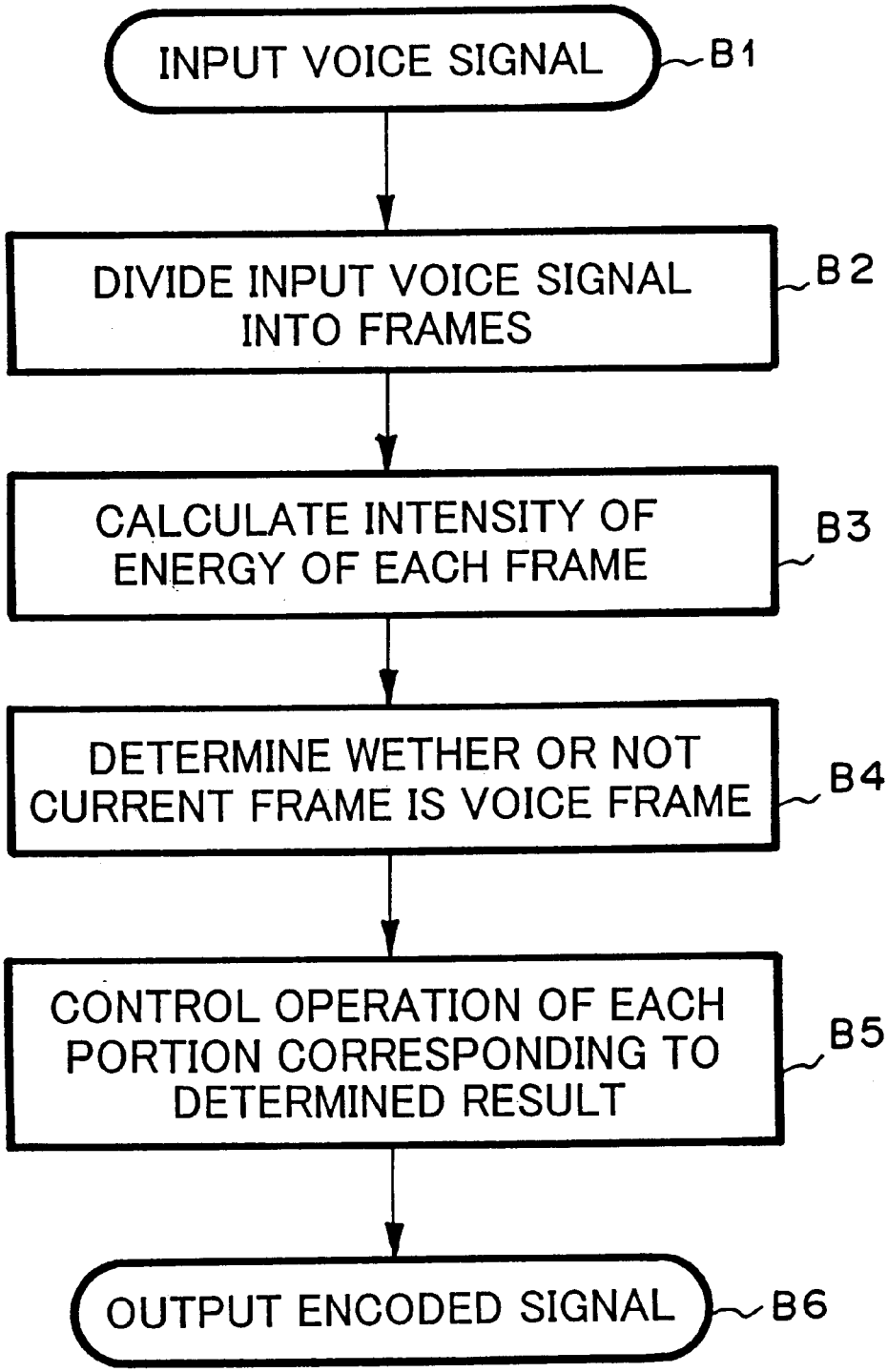
FIG.2 (PRIOR ART)
FIG. 2 is a flow chart showing the operation of the apparatus according to the related art reference.
Figure 3:
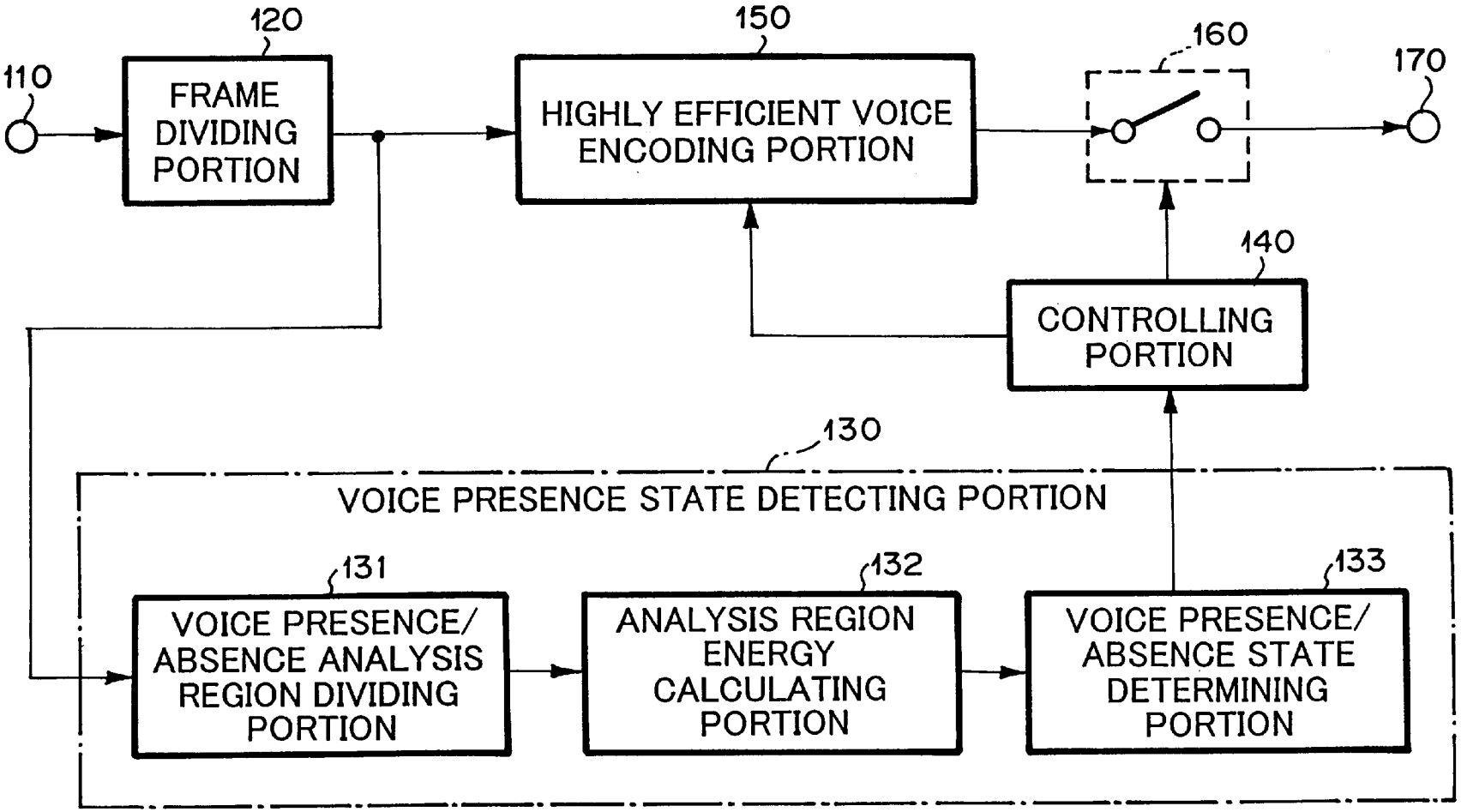
FIG. 3 is a block diagram showing the structure of a system according to a first embodiment of the present invention.

FIG. 3 shows the structure of a system according to a first embodiment of the present invention. Next, with reference to FIG. 3, the structure of the system according to the first embodiment will be described in brief.

In FIG. 3, a frame dividing portion 120 divides a voice signal received from an input terminal 120 at intervals of a predetermined time period (the divided portions are referred to as frames that are data units for a voice encoding process). The frames are supplied to a voice presence/absence analysis region dividing portion 131. The voice presence/absence analysis region dividing portion 131 divides each frame of the voice signal received from the frame dividing portion 120 at intervals of a shorter time period than the time period of each frame (hereinafter, the divided portions are referred to as analysis regions). The resultant voice signal is supplied to an analysis region energy calculating portion 132.

The analysis region energy calculating portion 132 calculates the intensity of energy of each analysis region of the voice signal received from the voice presence/absence analysis region dividing portion 131 and supplies the calculated data to a voice presence/absence state determining portion 133.

The voice presence/absence state determining portion 133 determines whether or not each frame of the input voice signal is a voice frame corresponding to the intensity of energy of each analysis region and the degree of variation therebetween as the calculated data received from the analysis region energy calculating portion 132 and supplies the determined result to a controlling portion 140.

In such a manner, each frame is divided into voice presence/absence determination analysis regions. The intensity of energy of each analysis region and the degree of variation therebetween are additionally used as voice presence/absence determination conditions. Thus, when a start of a phonation is present at the center position of a frame, the frame is determined as a voice frame. When a frame partly contains pulse noise, the frame is determined as a non-voice frame. Thus, a voice presence state detecting function with higher accuracy can be provided.

In addition, according to the present invention, the periodicity of each region of the voice signal is calculated. When the voice signal in at least one region is periodic, the frame including the region is determined as a voice frame. Thus, voice presence/absence states can be accurately detected.

First Embodiment

[Structure]

As described above, FIG. 3 is a block diagram showing the structure of a voice presence/absence state detecting apparatus according to the first embodiment of the present invention. Referring to FIG. 3, the voice presence/absence state detecting apparatus according to the first embodiment of the present invention comprises a voice signal input terminal 110, a frame dividing portion 120, a voice presence state detecting portion 130, a controlling portion 140, a highly efficient voice encoding portion 150, a switch 160, and an encoded data output terminal 133. The voice presence state detecting portion 130 comprises a voice presence/absence analysis region dividing portion 131, an analysis region energy calculating portion 132, and a voice presence/absence state determining portion 133.

The individual structural portions of the voice presence/absence state detecting apparatus according to the first embodiment have the following functions.

The frame dividing portion 120 divides a voice signal received from the voice signal input terminal 110 into frames and supplies the frames to the voice presence state detecting portion 130 and the highly efficient voice encoding portion 150.

The voice presence/absence analysis region dividing portion 131 divides each frame of the voice signal received from the frame dividing portion 120 into analysis regions and supplies the resultant voice signal to the analysis region energy calculating portion 132.

The analysis region energy calculating portion 132 calculates the intensity of energy of each analysis region of the voice signal and supplies the calculated data to the voice presence/absence state determining portion 133.

The voice presence/absence state determining portion 133 determines whether or not each frame is a voice frame corresponding to the intensity of energy of each analysis region and the degree of variation therebetween as the calculated data received from the analysis region energy calculating portion 132 and supplies the determined result to the controlling portion 140.

The controlling portion 140 controls the operations of the highly efficient voice encoding portion 150 and the switch 160 corresponding to the determined result received from the voice presence/absence state determining portion 133.

The highly efficient voice encoding portion 150 performs a highly efficient voice encoding process for each frame of the voice signal received from the frame dividing portion 120 and supplies the encoded data to the switch 160 under the control of the controlling portion 140.

The switch 160 causes the encoded data received from the highly efficient voice encoding portion 150 to be supplied or not to be supplied to the encoded data output terminal 170 under the control of the controlling portion 140.

[Operation]

The overall operation of the voice presence/absence state detecting apparatus according to the first embodiment will be described in brief.

The voice presence/absence state detecting apparatus according to the first embodiment of the present invention is used in a voice encoding/decoding apparatus for a portable telephone system, an automobile telephone system, and so forth. In other words, the voice presence/absence state detecting apparatus is used when the voice encoding apparatus determines whether or not an input voice signal contains a voice frame. When the input voice signal contains a voice frame, the voice encoding apparatus transmits the encoded voice signal to a decoding apparatus. When the input voice signal does not contain a voice frame, the voice encoding apparatus halts transmitting the encoded signal so as to reduce the transmission power.

Figure 4:
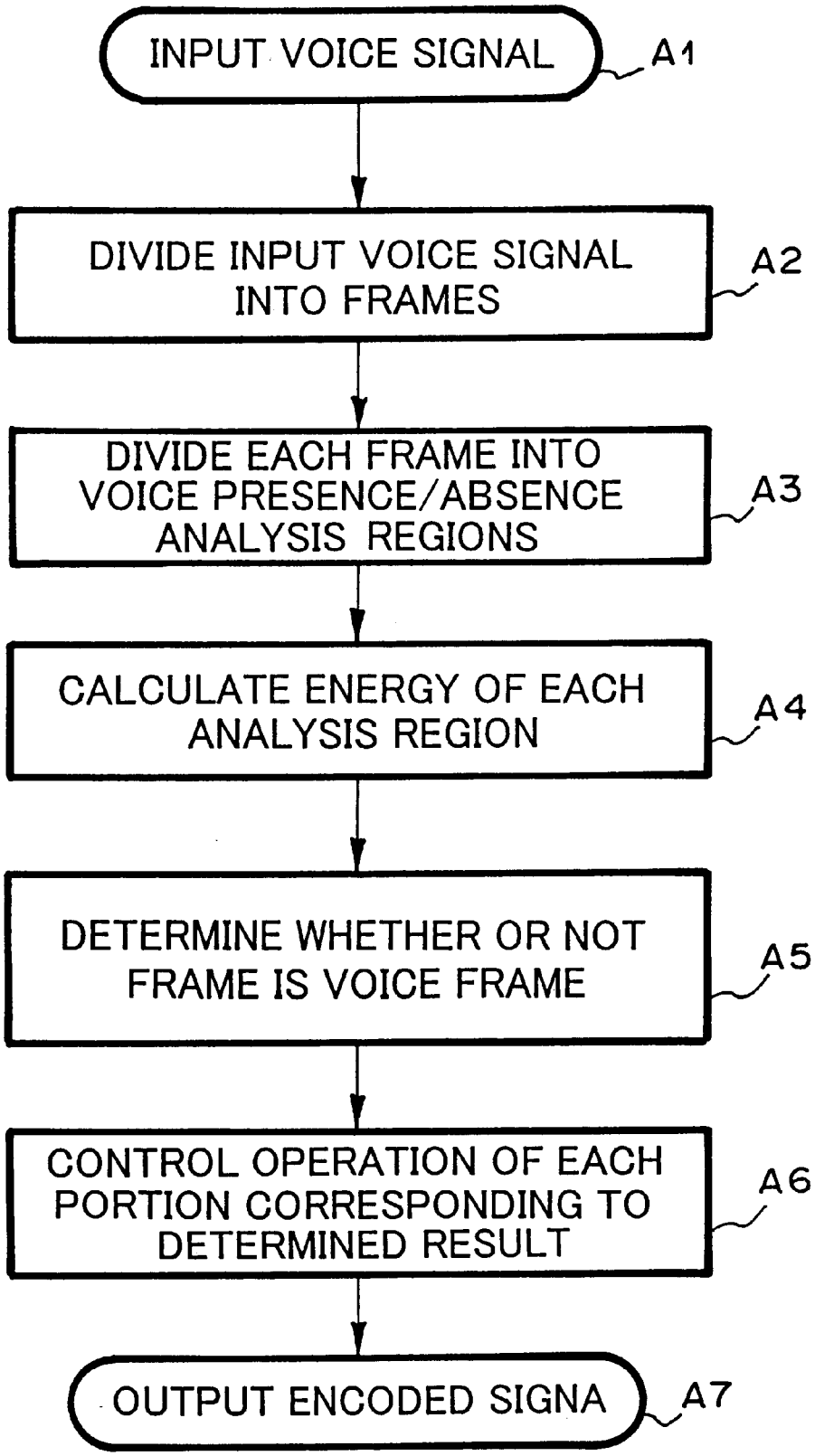
FIG. 4 is a flow chart showing the operation of the system according to the first embodiment of the present invention.
Figure 5A:
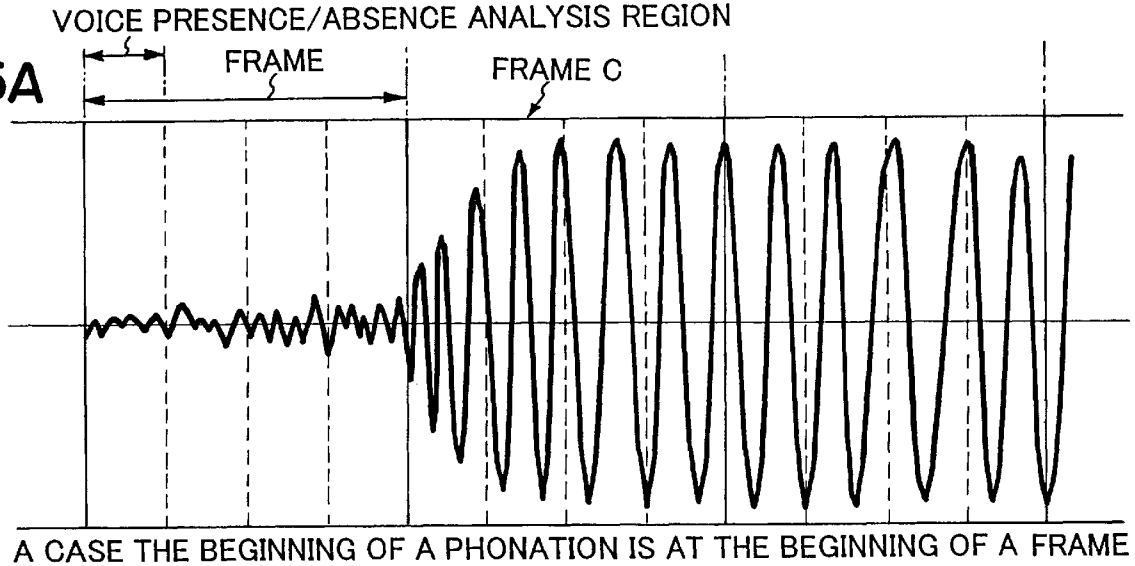
FIGS. 5A and 5B are graphs showing frames of voice signals according to the first embodiment of the present invention.
Figure 5B:
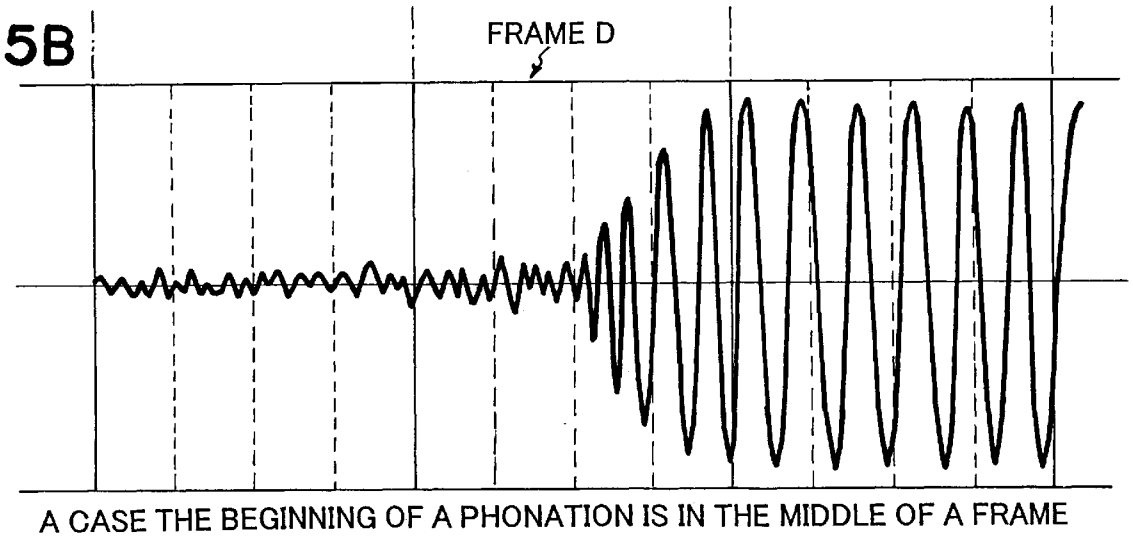

Next, with reference to FIGS. 3, 4, 5A and 5B, the overall operation of the voice presence/absence state detecting apparatus according to the first embodiment will be described. FIG. 4 is a flow chart for explaining the operation of the first embodiment. FIGS. 5A and 5B are graphs for explaining frames of voice signals according to the first embodiment.

The frame dividing portion 120 receives a voice signal from the voice signal input terminal 110 (at step A1) and divides the voice signal into frames (with a period of for example 20 msec each) and supplies the frames to the voice presence state detecting portion 130 and the highly efficient voice encoding portion 150 (at step A2).

The voice presence/absence analysis region dividing portion 131 divides each frame of the voice signal received from the frame dividing portion 120 into analysis regions (with a period of for example 5 msec each) and supplies the analysis regions to the analysis region energy calculating portion 132 (at step A3).

The analysis region energy calculating portion 132 calculates the intensity of energy of each analysis region of the voice signal received from the voice presence/absence analysis region dividing portion 131 and supplies the calculated data to the voice presence/absence state determining portion 133 (at step A4).

An input voice signal sampled at 8 kHz with a period of 20 msec is denoted by s(1), s(2), . . ., and s(160). At this point, the intensity of energy for 5 msec each is defined as the sum of square of the input voice signal. In other words, when the intensities of energy at regions t (t=1 to 4) are denoted by E(t), they are given by the following formulas.

$$E(1)=s(1)\times s(1)+s(2)\times s(2)+\ldots+s(40)\times s(4)$$

$$E(2)=s(41)\times s(41)+s(42)\times s(42)+\ldots+s(80)\times s(80)$$

$$E(3)=s(81)\times s(81)+s(82)\times s(82)+\ldots+s(120)\times s(120)$$

$$E(4)=s(121)\times s(121)+s(122)\times s(122)+\ldots+s(160)\times s(160)$$

The resultant E(1) to E(4) are supplied to the voice presence/absence state determining portion 133.

The voice presence/absence state determining portion 133 determines whether the input voice signal contains a voice frame corresponding to the intensity of energy of each analysis region and the degree of variation therebetween as the calculated data received from the analysis region energy calculating portion 132 and supplies the determined result to the controlling portion 140 (at step A5).

Next, an example of the determination method for determining whether or not an input voice signal contains a voice frame corresponding to the intensity of energy of each analysis region and change rate thereof will be described.

[Determination Condition A]

The voice presence/absence state determining portion 133 determines whether or not the average value of the intensity of energy of the individual analysis regions of the current frame is larger than a predetermined threshold value. When the average value is larger than the threshold value, the voice presence/absence state determining portion 133 determines that the frame is a voice frame. When the average value is equal to or smaller than the threshold value, the voice presence/absence state determining portion 133 determines that the frame is not a voice frame. Hereinafter, this determination condition is referred to as determination condition A. When the voice presence/absence determination threshold value is 1000 and the values of the intensity of energy of the analysis regions E(1) to E(4) are E(1)=985, E(2)=1029, E(3)=988, and E(4)=1002, the average value of E(1) to E(4) is (985+1029+988+1002)/4=1001>1000. Thus, the voice presence/absence state determining portion 133 determines that the frame is a voice frame.

[Determination Condition B]

Next, the voice presence/absence state determining portion 133 calculates the degree of variation of the value of the intensity of energy of each analysis region of a frame that has been determined as a non-voice frame corresponding to the determination condition A. When the degree of variation is larger then a predetermined threshold value, the voice presence/absence state determining portion 133 determines that the frame has a voice. Hereinafter, this determination condition is referred to as determination condition B.

Next, the voice presence/absence determining process corresponding to the determination condition B will be described in detail. When the beginning of a phonation is detected, the level of the voice signal (namely, the intensity of energy) sharply increases at the beginning of the phonation. For example, in the case of frame C shown in FIG. 5A, the beginning of a phonation is at the beginning of the frame. The values of the intensity of energy, E(1) to E(4), of the analysis regions are larger than a predetermined value. Thus, the probability that the frame C is determined as a voice frame corresponding to only the determination condition A may be high.

In contrast, in the case of frame D shown in FIG. 5B, the beginning of a phonation is in the middle of the frame. Although the values of the intensity of energy, E(3) and E(4), are large, the values of the intensity of energy, E(1) and E(2), are small. Thus, in the determination condition A, there is a probability that the frame D is determined as a non-voice frame. In contrast, in the determination condition B, the degree of variations of E(1) to E(4) are considered. For example, when the following conditions are satisfied for each frame, it is determined that the frame is a voice frame.

Condition B1: all variations: E(1)→E(2), E(2)→E(3), and E(3)→E(4) are positive values.

Condition B2: for n=3 or n=4, both 30×E(n−2)≦E (n−1) and 5×E(n−1)≦E(n) are satisfied.

The determination condition B supposes a case of the frame D shown in FIG. 5B. The beginning of a phonation in a voice signal is in the middle of the frame D and therefore, the intensity of energy sharply increases in the frame D.

When the values of the intensities of energies of analysis regions of a frame are E(1)=25, E(2)=29, E(3)=36, and E(4)=42, the variations: E(1)→E(2), E(2)→E(3), and E(3)→E(4) are all positive. However, since 30×E(1)>E (2), 5×E(2)>E(3), 30×E(2)>E (3), 5×E(3)>E(4), the frame is determined as a non-voice frame.

When the values of the intensities of energies of analysis regions of a frame are E(1)=21, E(2)=36, E(3)=1091, and E(4)=6242 as in the case of Frame D, since the variations: E(1)→E(2), E(2)→E(3), and E(3)→E(4) are all positive and the relations of 30×E(2)≦E (3), 5×E(3)≦E(4) are satisfied, the frame is determined as a voice frame.

When very large pulse noise instantaneously takes place in the communication environment and the values of the intensities of energies of analysis regions of a frame are E(1)=21, E(2)=6242, E(3)=456, and E(4)=72, since 30×E (1)≦E (2), 5×E(2)>E(3), 30×E(2)>E (3), 5×E(3)>E(4) and the determination condition B1 is not satisfied, the frame is determined as a non-voice frame.

When the values of the intensities of energies of analysis regions of a frame are E(1)=21, E(2)=72, E(3)=456, and E(4)=6242, although the determination condition B1 is satisfied, 30×E(1)>E (2), 5×E(2)<E(3), 30×E(2)>E (3), 5×E (3)<E(4) and the condition B2 is not satisfied. In other words, the variation is too abrupt to be determined as the beginning of a phonation. Thus, the frame is determined as a non-voice frame. In other words, the determination condition B is satisfied only when both the conditions B1 and B2 are satisfied.

Thus, if both the conditions B1 and B2 are satisfied, then the condition B is satisfied. If the conditions B1 and B2 are satisfied for a frame, the frame is determined as a voice frame containing a beginning of a phonation rather than a frame containing a pulse noise.

Finally, when at least one of determination conditions A and B is satisfied, the current frame is determined as a voice frame.

The finally determined result is supplied to the controlling portion 140.

The coefficients of the condition B2 are set so that the degree of a variation corresponding to a beginning of a phonation results in that the condition B2 is satisfied, while the degree of a variation corresponding to a noise pulse results in that the condition B2 is not satisfied.

The controlling portion 140 controls the operations of the highly efficient voice encoding portion 150 and the switch 160 corresponding to the determined result of the voice presence/absence state determining portion 133 (at step A5). As an example of the controlling method of the highly efficient voice encoding portion 150, when the current frame is a voice frame, the controlling portion 140 supplies a command that causes the highly efficient voice encoding portion 150 to perform the voice encoding process. When the current frame is a non-voice frame, the controlling portion 140 outputs a command for performing the background noise encoding process so as to encode the background noise in the non-voice state.

As an example of the controlling method of the switch 160, when the current frame is a voice frame, the switch 160 is operated so that the output signal of the highly efficient voice encoding portion 150 is supplied to the encoded signal output terminal 170. When the current frame is a non-voice frame, the switch 160 is operated so that the encoded data is not supplied to the encoded signal output terminal 170.

The controlling portion 140 may control only one of the highly efficient voice encoding portion 150 and the switch 160. Alternatively, the controlling portion 140 may control both the highly efficient voice encoding portion 150 and the switch 160.

Second Embodiment

Figure 6:
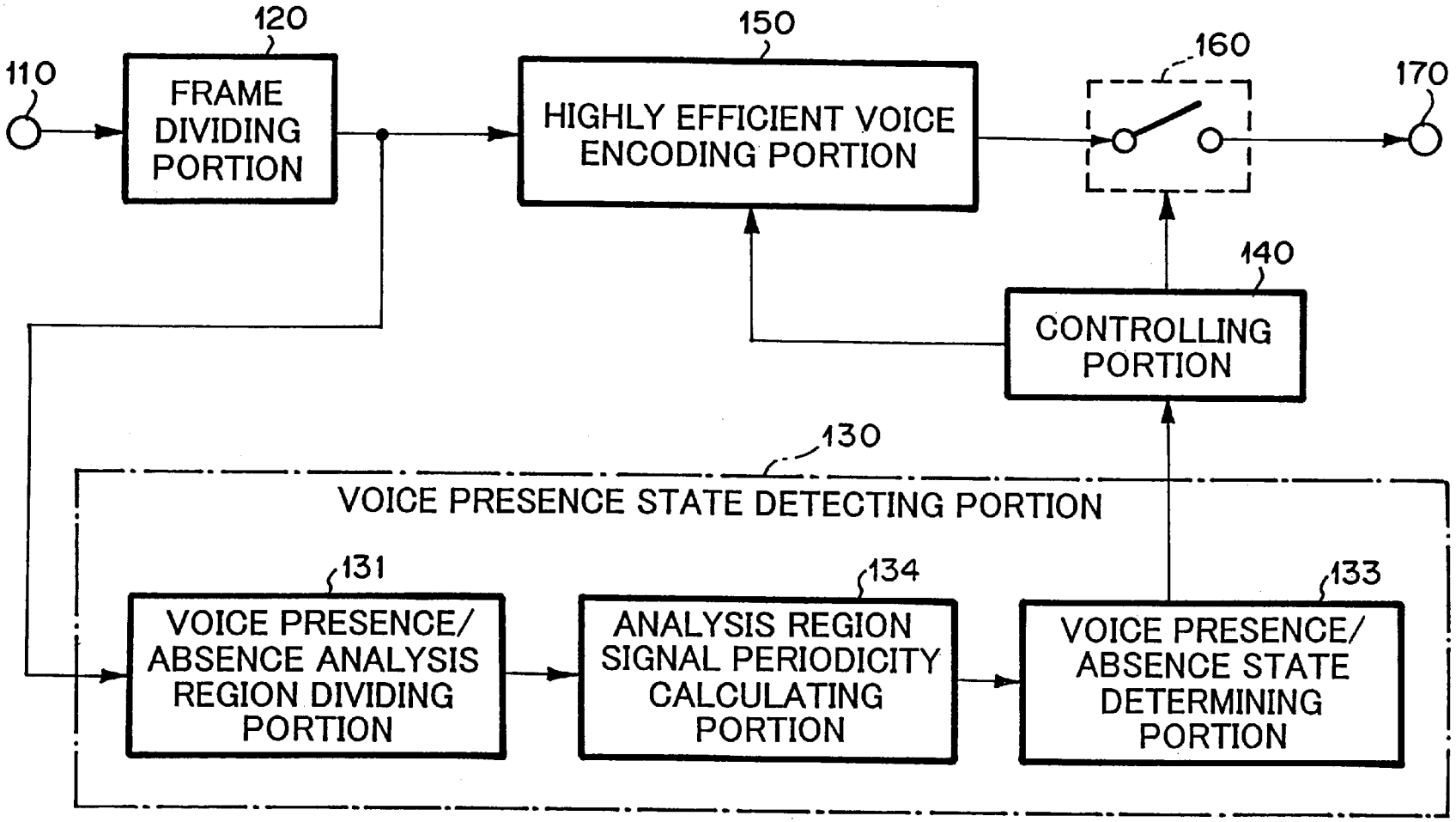
FIG. 6 is a block diagram showing the structure of a system according to a second embodiment of the present invention.

Next, with reference to the accompanying drawings, a second embodiment of the present invention will be described in detail. FIG. 6 is a block diagrams showing the structure of a voice presence/absence state detecting apparatus according to the second embodiment.

Referring to FIG. 6, the analysis region energy calculating portion 132 shown in FIG. 3 is replaced by an analysis region signal periodicity calculating portion 134.

The analysis region signal periodicity calculating portion 134 receives analysis region data of a voice signal from a voice presence/absence analysis region dividing portion 131, calculates the periodicity of each analysis region of the input voice signal, and supplies the calculated result to a voice presence/absence state determining portion 133.

Next, with reference to FIGS. 6 and 7, the operation of the voice presence/absence state detecting apparatus according to the second embodiment will be described in detail.

Figure 7:
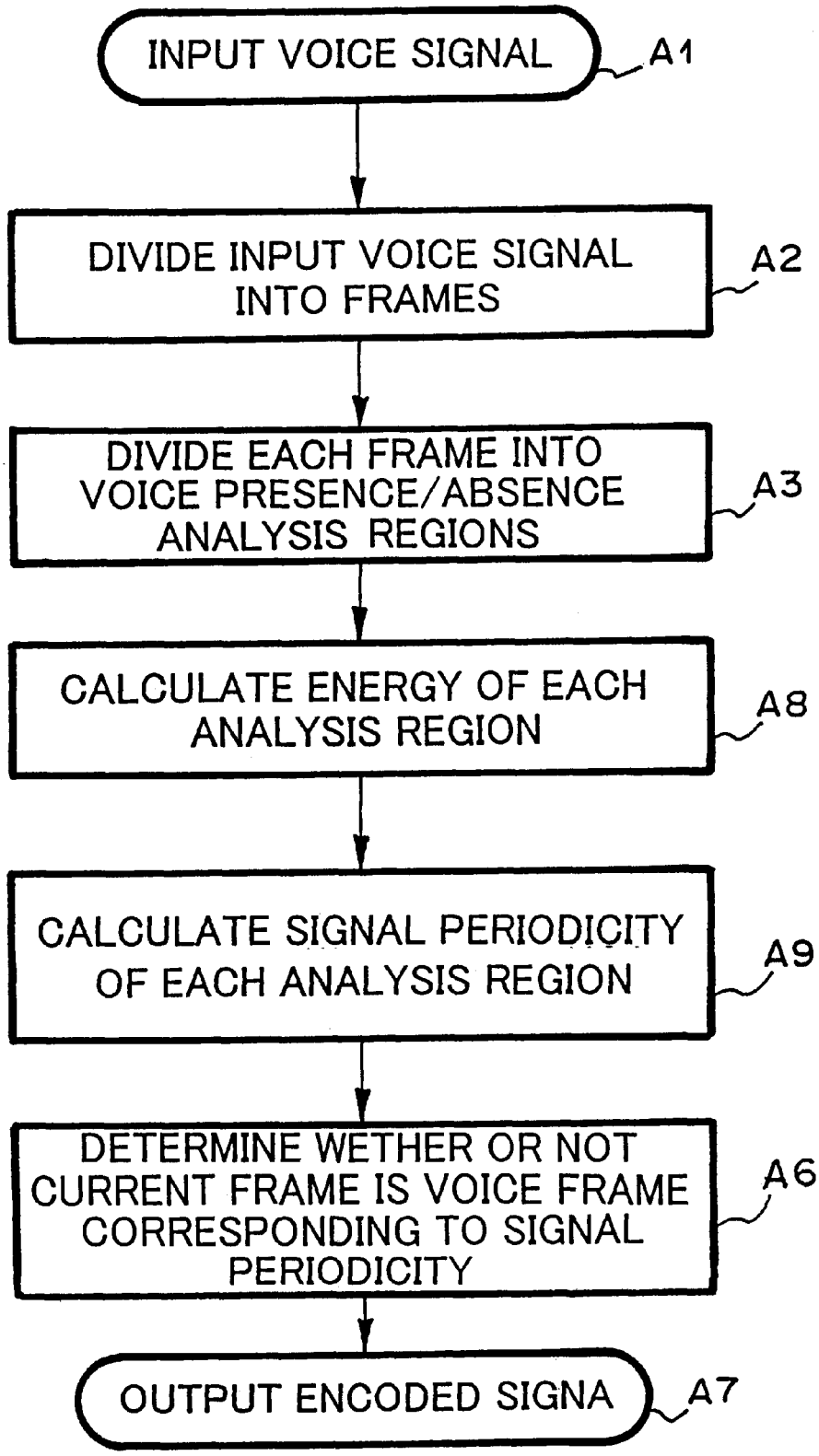
FIG. 7 is a flow chart showing the operation of the system according to the second embodiment of the present invention.

FIG. 7 is a flow chart showing the operation of the voice presence/absence state detecting apparatus according to the second embodiment. Referring to FIG. 7, the analysis region energy calculating process at step A4 shown in FIG. 4 is replaced by an analysis region signal periodicity calculating process at step A8. In addition, the frame voice presence/absence determining process at step A5 shown in FIG. 4 is replaced by a signal periodicity voice presence/absence determining process at step A9. The processes at steps A1, A2, A3, A6, and A7 shown in FIG. 7 are the same as those in FIG. 4. For simplicity, the description of these steps is omitted.

Next, the processes at steps A8 and A9 shown in FIG. 7 will be described. The analysis region signal periodicity calculating portion 134 calculates the periodicity of each analysis region of the voice signal received from the voice presence/absence analysis region dividing portion 131 and supplies the calculated result to the voice presence/absence state determining portion 133 (at step A8).

Generally, since the voice signal has periodicity, when it is determined that "the signal is periodic", the signal can be presumed to be of a phonation. As an example of pitch searching method used in highly efficient voice encoding system such as CELP (Code Excited Linear Prediction), the periodicity of each analysis region of an input voice signal can be calculated.

The voice presence/absence state determining portion 133 determines whether or not the input voice signal is a voice corresponding to the periodicity of each analysis region of the input voice signal received from the analysis region signal periodicity calculating portion 134 and supplies the determined result to the controlling portion 140 (at step A9).

As the determined results of the voice presence/absence state determining portion 133 for four analysis regions of a 20 msec frame, when the first and second analysis regions do not have periodicity and the third and fourth analysis regions have periodicity, the voice presence/absence state determining portion 133 presumes that the later portion of the frame has periodicity and thereby determines that the frame is a voice frame. The number of analysis regions which has high periodicity for determining the corresponding frame is a voice frame may be set in accordance with an application and is set to one at least.

In the second embodiment, it is determined whether or not each frame is a voice frame corresponding to the periodicity of each analysis region of the voice signal as a determination condition. However, the determination condition of the second embodiment may be combined with one of or both of the determination conditions A and B.

The determination conditions of the first embodiment may be combined with another condition which are not explained above. The same applies the determination condition of the second embodiment.

In the first and second embodiments, only the beginning of a phonation in a voice signal is detected. However, it is needless to say that the end of a phonation may be detected by using the method of the first and second embodiments.

In addition, according to the first and second embodiments, the operation of the voice encoding apparatus is controlled corresponding to the determined result of the voice presence/absence determining process. Alternatively, corresponding to the determined result of the voice presence/absence determining process, the operation of the voice recognizing apparatus may be controlled.

A first effect of the present invention is that the probability that a frame that has change of a voice presence/absence state in the middle thereof can be accurately determined as a voice frame is high.

This is because it is determined whether or not each frame is a voice frame corresponding to both the intensity of energy of each analysis region that is shorter than each frame and the degree of variation of the intensity of energy or at least the degree of the variation.

As a second effect of the present invention, the probability that a frame that partly contains pulse noise can be accurately determined as a non-voice frame is high.

This is because the degree of variation of the intensity of energy of each analysis region is additionally used as a determination condition. This is also because too abrupt variation is not presumed to be caused by a phonation.

Although the present invention has been shown and described with respect to the best mode embodiment thereof, it should be understood by those skilled in the art that the foregoing and various other changes, omissions, and additions in the form and detail thereof may be made therein without departing from the spirit and scope of the present invention.

What is claimed is:

1. A method for encoding a voice signal, comprising steps of:

dividing a voice signal into frames:

detecting a voice presence/absence state of each frame;

encoding the voice signal for each frame; and determining whether to output the encoded voice signal for each frame;

wherein the steps of encoding and determination are controlled by a result of the step of detection; and wherein the step of detection comprises steps of:

dividing the frame into sub-frames;

calculating an amount of energy of the voice signal in each sub-frame; and determining whether the frame is in a voice presence state or a voice absence state on the basis of a individual degrees of variation of the energies of adjoining sub-frames for multiple pairs of adjoining sub-frames of the frame.

2. The method according to claim 1 wherein in the step of determining whether the frame is in the voice presence state or the voice absence state, it is determined that the frame is in the voice presence state when the degree of variation is representative of a beginning of a phonation, whereas it is determined that the frame is in the voice absence state when the degree of variation is more abrupt than the variation of the beginning of the phonation.

3. The method according to claim 1 wherein in the step of determining whether the frame is in the voice presence state or the voice absence state determination, it is determined whether the frame is in the voice presence state or the voice absence state on the basis of the value of the amount of energy each sub-frame in addition to the degrees of variation of the energies of adjoining sub-frames.

4. An apparatus for encoding a voice signal, comprising:

means for dividing a voice signal into frames:

means for detecting a voice presence/absence state of each frame;

means for encoding the voice signal for each frame; and means for determining whether to output the encoded voice signal for each frame;

wherein said means for encoding and means for determination are controlled by an output of said means for detection; and wherein said means for detection comprises:

means for dividing the frame into sub-frames;

means for calculating an amount of energy of the voice signal in each sub-frame; and means for determining whether the frame is in a voice presence state or a voice absence state on the basis of individual degrees of variation of the energies of adjoining sub-frames for multiple pairs of adjoining sub-frames of the frame.

5. The apparatus according to claim 4 wherein said means for determining whether the frame is in the voice presence state or the voice absence state determines that the frame is in the voice presence state when the degree of variation is representative of a beginning of a phonation, whereas said means for determining whether the frame is in a voice presence state or a voice absence state determines that the frame is in the voice absence state when the degree of variation is more abrupt than the variation of the beginning of the phonation.

6. The apparatus according to claim 4, wherein said means for determining whether the frame is in the voice presence state or the voice absence state determines whether the frame is in the voice presence state or the voice absence state on the basis of the value of the amount of energy of each sub-frame in addition to the degrees of variation of the energies of adjoining sub-frames.

* * * * *